US005354484A

United States Patent [19]

Schwind et al.

[11] Patent Number: 5,354,484

[45] Date of Patent: Oct. 11, 1994

[54] PHOSPHORUS-CONTAINING LUBRICANT AND FUNCTIONAL FLUID COMPOSITIONS

[75] Inventors: James J. Schwind, Eastlake; Stephen A. Di Biase, Euclid, both of Ohio

[73] Assignee: The Lubrizol Corporation, Wickliffe, Ohio

[21] Appl. No.: 534,830

[22] Filed: Jun. 7, 1990

Related U.S. Application Data

[63] Continuation-in-part of Ser. No. 874,267, Jun. 13, 1986, abandoned.

[51] Int. Cl.[5] ..... C01M 141/10; C01M 141.12

[52] U.S. Cl. ..... 252/32.5; 252/32.7 E; 252/46.6; 252/46.7; 252/49.6

[58] Field of Search ..... 252/32.7 E, 46.6, 46.7, 252/49.9, 32.5, 33, 46.3, 47.5, 49.6, 42.7

[56] References Cited

U.S. PATENT DOCUMENTS

| | | | |
|---|---|---|---|
| 2,228,671 | 1/1941 | Neely et al. | 252/42.7 |
| 2,413,852 | 1/1947 | Turner | 252/49.9 |
| 2,605,226 | 7/1952 | Vaughn | 252/49.9 |
| 3,033,789 | 5/1962 | Asseff | 252/49.9 |
| 3,087,936 | 4/1963 | LeSuer | 260/326.3 |
| 3,172,892 | 3/1965 | LeSuer et al. | 260/326.5 |
| 3,197,405 | 7/1965 | LeSuer | 252/32.7 E |
| 3,219,666 | 11/1965 | Norman et al. | 260/268 |
| 3,265,618 | 8/1966 | Henderson et al. | 252/32.5 |
| 3,267,033 | 8/1966 | Allen | 252/32.7 |
| 3,272,746 | 9/1966 | LeSuer et al. | 252/47.5 |
| 3,284,409 | 11/1966 | Dorer | 252/49.9 |
| 3,318,811 | 5/1967 | Conradi et al. | 252/49.9 |
| 3,357,920 | 12/1967 | Nacson | 252/49.9 |
| 3,484,375 | 12/1969 | Hu | 252/49.9 |
| 3,513,093 | 5/1970 | LeSuer | 252/32.5 |
| 3,901,932 | 8/1975 | Tada et al. | 260/455 P |
| 3,925,213 | 12/1975 | Froeschmann et al. | 252/25 |
| 4,101,427 | 7/1978 | Shoub | 252/32.7 E |
| 4,118,328 | 10/1978 | Hotten | 252/32.5 |
| 4,163,729 | 8/1979 | Adams | 252/18 |
| 4,207,195 | 6/1980 | Horodysky | 252/46.6 |
| 4,337,161 | 6/1982 | Stayner | 252/49.5 |
| 4,338,205 | 7/1982 | Wisotsky | 252/49.9 |
| 4,431,552 | 2/1984 | Salentine | 252/32.7 E |
| 4,472,288 | 9/1984 | Frost | 252/32.7 E |
| 4,575,431 | 3/1986 | Salentine | 252/49.9 |
| 4,612,128 | 9/1986 | Uematsu et al. | 252/49.8 |

FOREIGN PATENT DOCUMENTS

| | | |
|---|---|---|
| 1117349 | 6/1968 | United Kingdom . |
| 2052505A | 1/1981 | United Kingdom . |

*Primary Examiner*—Margaret Medley

*Attorney, Agent, or Firm*—Joseph P. Fischer; Frederick D. Hunter, Sr.; James L. Cordek

[57] ABSTRACT

This invention is directed to lubricating oil and functional fluid compositions having improved high temperature stability and which contain at least one phosphorus-containing composition and at least one oil-soluble nitrogen-containing composition. More particularly, the lubricating and functional fluid compositions of the present invention comprise (A) a major amount of an oil of lubricating viscosity, and a minor amount of (B-1) at least one soluble tertiary aliphatic primary amine salt of a substituted phosphoric acid composition characterized by the formula

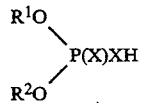

(I)

wherein $R^1$ is hydrogen or a hydrocarbyl group, $R^2$ is a hydrocarbyl group, and both X groups are either O or S, and (C) at least one soluble nitrogen-containing composition prepared by the reaction of a hydrocarbon-substituted succinic acid-producing compound with at least about one-half equivalent, per equivalent of acid producing compound, of an amine containing at least one hydrogen attached to a nitrogen atom. Preferably, the amine salts of the phosphoric acids utilized in the lubricating compositions of the present invention are derived from primary amines, and the soluble nitrogen-containing compositions (C) also contain boron. The lubricating compositions of the present invention are particularly useful in gear applications requiring high thermal stability such as from about 160° C. with intermittent operation up to about 200° C.

57 Claims, No Drawings

PHOSPHORUS-CONTAINING LUBRICANT AND FUNCTIONAL FLUID COMPOSITIONS

CROSS-REFERENCE TO RELATED APPLICATION

This application is a continuation-in-part of pending application Ser. No. 874,267 filed Jun. 13, 1986, now abandoned and the disclosure of the prior application is incorporated herein in its entirety. Priority under 35 USC 120 with respect to the disclosure contained in said prior application Ser. No. 874,267, now abandoned is claimed.

TECHNICAL FIELD OF THE INVENTION

This invention relates to lubricating oil and functional fluid compositions having improved high temperature stability and which are useful for lubricating relatively moving metal surfaces. More particularly, the invention relates to lubricating compositions useful in automotive transmissions and axles.

BACKGROUND OF THE INVENTION

The problems associated with the lubrication of gears such as utilized in automotive transmissions and axles are well known to those skilled in the art. In the lubrication of automatic transmissions, proper fluid viscosity at both low and high temperatures is essential to successful operation. Good low temperature fluidity eases cold weather starting and insures that the hydraulic control system will properly "shift gears". High viscosity at elevated temperatures insures pumpability and the satisfactory operation of converters, valves, clutches, gears and bearings. These conflicting fluidity requirements require a product that exhibits the following characteristics:

(a) high temperature viscosity retention,
(b) low temperature fluidity,
(c) shear stability, and
(d) high temperature stability.

In order to prepare lubricants having these characteristics, it has become common practice to add a variety of chemicals to the lubricating oil. For example, in order to meet the viscosity requirements, compositions have been added to the oils which are characterized by relatively small change in their viscosity with changing temperature. In general, lubricants containing such compositions have the desirable properties of functioning immediately, even though cold, upon being put into service, and to continue to function satisfactorily as they become heated during operation. Commonly used gear oil viscosity improvers include polymethacrylates and polyolefins.

In addition to viscosity improvers, lubricating compositions useful as gear lubricants generally will contain pour point depressants, extreme pressure agents, oxidation inhibitors, corrosion inhibitors, foam inhibitors, and friction modifiers.

Lubricating compositions have been suggested containing various nitrogen-containing and phosphorus-containing compositions to impart desirable properties to lubricating compositions. For example, U.S. Pat. No. 3,513,093 describes lubricant compositions containing substituted polyamines which comprise the reaction product of an alkylene amine with a substantially hydrocarbon-substituted succinic acid and at least about 0.001 mole of a phosphorus acid-producing compound selected from the group consisting of phosphoric acids, phosphorous acids, phosphonyl acids, phosphinyl acids, and the esters, the halides and the anhydrides thereof. The substituted polyamines are useful as anti-wear agents, anti-rust agents, detergents, etc. U.S. Pat. No. 4,338,205 describes a lubricating oil with improved diesel dispersancy. The lubricating oils contain an acid-treated, oil-soluble alkenyl succinimide or a borated alkenyl succinimide which has been treated at an elevated temperature with an oil-soluble strong acid such as an alkyl sulfonic acid, or a phosphoric acid. The oil-soluble organic acids are generally classified as those acids containing a hydrogen-phosphorus moiety which has a pK of $-10$ to about $+5.0$.

More recently, new demands are being placed on lubricants to be used in gear applications. Increases in commercial vehicle power and loading require the lubricant to be able to withstand severe thermal stressing while protecting the equipment being lubricated. Thus, the high temperature stability (e.g., above about 160° C.) of lubricants designed for gear applications is a significant consideration.

SUMMARY OF THE INVENTION

This invention is directed to lubricating oil and functional fluid compositions having improved high temperature stability and which contain at least one phosphorus-containing composition and at least one soluble nitrogen-containing composition. More particularly, the lubricating and functional fluid compositions of the present invention comprise (A) a major amount of an oil of lubricating viscosity, and a minor amount of (B-1) at least one soluble amine salt of at least one substituted phosphoric acid composition characterized by the formula

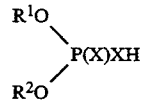

(I)

wherein $R^1$ is hydrogen or a hydrocarbyl group, $R^2$ is a hydrocarbyl group, and both X groups are either O or S, and (C) at least one soluble nitrogen-containing composition prepared by the reaction of a hydrocarbon-substituted succinic acid-producing compound with at least about one-half equivalent, per equivalent of acid producing compound, of an amine containing at least one hydrogen attached to a nitrogen atom.

Preferably, the amine salts of the phosphoric acids utilized in the lubricating compositions of the present invention are derived from primary amines, and the soluble nitrogen-containing compositions (C) also contain boron. The lubricating compositions of the present invention are particularly useful in gear applications requiring high thermal stability such as from about 160° C. with intermittent operation up to about 200° C.

DESCRIPTION OF THE PREFERRED EMBODIMENTS

A. Oil of Lubricating Viscosity

The lubricating and functional fluid compositions of the present invention are based on diverse oils of lubricating viscosity, including natural and synthetic lubricating oils and mixtures thereof. These lubricating compositions containing the phosphorus-containing and nitrogen-containing compositions of the invention, are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the compositions of this invention. The lubricating compositions are particularly effective as gear lubricants.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy)disiloxane, poly(methyl) siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

B-1. Amine Salts of Substituted Phosphoric Acid Compositions

The amine salts of substituted phosphoric acid compositions useful in the lubricants of the present invention may be characterized as compositions of the formula

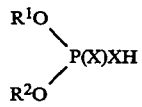

(I)

wherein $R^1$ is hydrogen or a hydrocarbyl group, $R^2$ is a hydrocarbyl group, and both X groups are either O or S.

The amine salts are either oil-soluble or soluble in the oil-containing compositions of the present invention. A preferred method of preparing compositions containing (I) comprises reacting at least one hydroxy compound of the formula ROH with a phosphorus compound of the formula $P_2X_5$ wherein R is a hydrocarbyl group and X is O or S. The phosphorus-containing compositions obtained in this manner are mixtures of phosphorus compounds, and are generally mixtures of mono- and dihydrocarbyl-substituted phosphoric and/or dithiophosphoric acids depending on a choice of phosphorus reactant (i.e., $P_2O_5$ or $P_2S_5$).

As used in this specification and appended claims, the terms "hydrocarbyl" or "hydrocarbon-based" denote a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based group", "aryl-based group" and the like have meaning analogous to the above with respect to alkyl and aryl groups and the like.

The hydroxy compound used in the preparation of the phosphorus-containing compositions of this invention are characterized by the formula ROH wherein R is a hydrocarbyl group. The hydroxy compound reacted with the phosphorus compound may comprise a mixture of hydroxy compounds of the formula ROH wherein the hydrocarbyl group R contains from about 1 to 30 carbon atoms. It is necessary, however, that the amine salt of the substituted phosphoric acid composition ultimately prepared is soluble in the lubricating compositions of the present invention. Generally, the R group will contain at least 4 carbon atoms and more preferably at least about 8 carbon atoms.

The R group may be aliphatic or aromatic such as alkyl, aryl, alkaryl, aralkyl and alicyclic hydrocarbon groups. Examples of useful hydroxy compounds of the formula ROH includes, for example, ethyl alcohol, n-butyl alcohol, hexyl alcohol, 2-ethyl-hexyl alcohol, nonyl alcohol, dodecyl alcohol, stearyl alcohol, amyl phenol, octyl phenol, nonyl phenol, methyl cyclohexanol, alkylated naphthol, etc.

The preferred alcohols, ROH, are aliphatic alcohols and more particularly, primary aliphatic alcohols containing at least about 4 carbon atoms, and more generally at least about 8 carbon atoms. Accordingly, examples of the preferred monohydric alcohols ROH which are useful in the present invention include, 1-octanol, 1-decanol, 1-dodecanol, 1-tetradecanol, 1-hexadecanol, 1-octadecanol, oleyl alcohol, linoleyl alcohol, linolenyl alcohol, phytol, myricyl alcohol, lauryl alcohol, myristyl alcohol, cetyl alcohol, stearyl alcohol and behenyl alcohol.

Of course, commercial alcohols (including mixtures) are contemplated herein, and these commercial alcohols may comprise minor amounts of alcohols which, although not specified herein, do not detract from the major purposes of this invention. Higher synthetic monohydric alcohols of the type formed by the Oxo process (e.g., 2-ethyl-hexyl), the aldol condensation, or by organoaluminum-catalyzed oligomerization of alphaolefins (especially ethylene), followed by oxidation, also are useful.

Examples of some preferred monohydric alcohols and alcohol mixtures useful in preparing the compositions of the invention include commercially available "Alfol" alcohols marketed by Continental Oil Corporation. Alfol 810 is a mixture containing alcohols consisting essentially of straight chain, primary alcohols having from 8 to 10 carbon atoms. Alfol 12 is a mixture comprising mostly $C_{12}$ fatty alcohols. Alfol 1218 is a mixture of synthetic primary straight chain alcohols having 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

The molar ratio of the hydroxy compound ROH to phosphorus reactant $P_2X_5$ in the reaction should be within the range of from about 1:1 to about 4:1, the preferred ratio being 3:1. The reaction may be effected simply by mixing the two reactants at an elevated temperature such as temperatures above about 50° C. up to the composition temperature of any of the reactants or the desired product. Preferably, the temperature is between about 50° C. and 150° C., and is most often below about 100° C. The reaction may be carried out in the presence of a solvent which facilitates temperature control and mixing of the reactants. The solvent may be any inert fluid substance in which either one or both reactants are soluble, or the product is soluble. Such solvents include benzene, toluene, xylene, n-hexane, cyclohexane, naphtha, diethyl ether carbitol, dibutyl ether dioxane, chlorobenzene, nitrobenzene, carbon tetrachloride or chloroform.

The product of the above reaction is acidic, but its chemical constitution is not precisely known. Evidence indicates, however, that the product is a mixture of acidic phosphates consisting predominantly of the mono- and di-esters of phosphoric acid (or thio- or dithiophosphoric acid), the ester group being derived from the alcohol ROH.

Another method for preparing the substituted phosphoric acid compositions useful in the preparation of the amine salts (B-1) comprises the reaction of a suitable alcohol such as those illustrated above with phosphoric acid at an elevated temperature, generally above 50° C., and more generally, at a temperature between about 50° C. and 150° C. The molar ratio of the alcohol to phosphoric acid to be used in the reaction may range from about 1:1 to 3:1. Still another method for preparing useful substituted phosphoric acids involves the reaction of a phosphorus halide or phosphorus oxy halide with a suitable alcohol or an epoxide such as ethylene oxide, propylene oxide, 1,2-butene oxide, 1,2-octene oxide, styrene oxide, or cyclohexene oxide. The reaction of a phosphorus halide such as phosphorus trichloride or tribromide with an epoxide proceeds to form a halogen-containing intermediate, usually a partially esterified phosphorus halide. The intermediate can be converted to the corresponding partially esterified phosphoric acid by reaction with water and oxygen.

The amine salts (B-1) of the present invention can be prepared by reaction of the above-described substituted phosphoric acids such as represented by Formula I with at least one amino compound which may be a primary, secondary or tertiary amine. Preferably the amines which are reacted with the substituted phosphoric acids to form the amine salts (B-1) are primary or secondary hydrocarbyl amines having the general formula $$R'R''NH$$

wherein R′ is a hydrocarbyl group and R″ is hydrogen or a hydrocarbyl group. Generally, the hydrocarbyl groups R′ and R″ will contain up to about 150 carbon atoms and will more often be aliphatic hydrocarbyl groups containing from about 4 to about 30 carbon atoms.

In one preferred embodiment, the hydrocarbyl amines which are useful in preparing the amine salts of the present invention are primary hydrocarbyl amines containing from about 4 to about 30 carbon atoms in the hydrocarbyl group, and more preferably from about 8 to about 20 carbon atoms in the hydrocarbyl group. The hydrocarbyl group may be saturated or unsaturated. Representative examples of primary saturated amines are those known as aliphatic primary fatty amines and commercially known as "Armeen" primary amines (products available from Armak Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Armak's Armeen-C, Armeen-O, Armeen-OL, Armeen-T, Armeen-HT, Armeen S and Armeen SD.

In another preferred embodiment, the amine salts of the composition of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

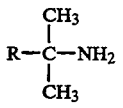

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are quite useful. Thus, the R′ and R″ groups may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

Secondary amines include dialkylamines having two of the above alkyl groups including such commercial fatty secondary amines as Armeen 2C and Armeen HT, and also mixed dialkylamines where R′ is a fatty amine and R″ may be a lower alkyl group (1–9 carbon atoms) such as methyl, ethyl, n-propyl, i-propyl, butyl, etc., or R″ may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono-or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen O" (N-oleyl-1,3-diaminopropane). "Duomeens" are commercially available diamines described in Product Data Bulletin No. 7-10R1 of Armak Chemical Co., Chicago, Ill.

Other primary amines useful in the preparation of the amine salts (B-1) are the primary ether amines $R''OR'NH_2$ wherein R' is a divalent alkylene group having 2 to 6 carbon atoms and R'' is a hydrocarbyl group of about 5 to about 150 carbon atoms. These primary ether amines are generally prepared by the reaction of an alcohol R''OH with an unsaturated nitrile. The R'' group of the alcohol can be a hydrocarbon-based group having up to about 150 carbon atoms. Typically, and for efficiency and economy, the alcohol is a linear or branched aliphatic alcohol with R'' having up to about 50 carbon atoms, preferably up to 26 carbon atoms and most preferably R'' has from 6 to 20 carbon atoms. The nitrile reactant can have from 2 to 6 carbon atoms with acrylonitrile being most preferred. Ether amines are known commercial products which are available under the name SURFAM TM produced and marketed by Mars Chemical Company, Atlanta, Ga. Typical of such amines are those having from about 150 to about 400 molecular weight. Preferred etheramines are exemplified by those identified as SURFAM P14AB (branched $C_{14}$), SURFAM P16A (linear $C_{16}$), SURFAM P17AB (branched $C_{17}$). The carbon chain lengths (i.e., $C_{14}$, etc.) of the SURFAMS described above and used hereinafter are approximate and include the oxygen ether linkage. For example, a $C_{14}$ SURFAM would have the following general formula $$C_{10}H_{21}OC_3H_6NH_2$$

The oil-soluble amine salts (B-1) are prepared by mixing the above-described substituted phosphoric acid compositions with the above-described amines at room temperature or above. Generally, mixing at room temperature for a period of from up to about one hour is sufficient. The amount of amine reacted with the substituted phosphoric acid compositions to form the salts of the invention is at least about one equivalent weight of the amine (based on nitrogen) per equivalent of phosphoric acid, and the ratio of equivalents generally is about one.

The following examples illustrate the preparation of the amine salts of the substituted phosphoric acid compositions which are useful in the present invention. Unless otherwise indicated in the following examples and elsewhere in the specification and claims, all parts and percentages are by weight, and all temperatures are in degrees centigrade.

EXAMPLE B-1-A

To a fatty alcohol (6 moles) having an average of 13 carbon atoms and obtained by the hydrogenation of coconut oil there is added at 50°–80° C. within a period of 2.5 hours, 2 moles of phosphorus pentoxide. The mixture is heated at 80° C. for 3 hours and filtered. The filtrate is the desired partially esterified phosphoric acid having a phosphorus content of 8.5% and an acid number of 216 (phenolphthalein indicator). To 518 grams (2 acid equivalents) of this acidic ester there is added at 35°–60° C. a stoichiometrically equivalent amount (i.e., 2 equivalents) of Primene 81-R, a commercial tertiary-alkyl primary amine mixture having from 11 to 14 carbon atoms in the alkyl group and an average equivalent weight of 191 (based on nitrogen). The resulting mixture is agitated for 30 minutes. The product is a salt of the amine and the acidic ester having a phosphorus content of 4.7% and a nitrogen content of 3.1%.

EXAMPLE B-1-B

A salt is prepared by the procedure of Example B-1-A except that the partially esterified phosphoric acid is derived from a mixture of equimolar amounts of the alcohol reactant and phosphorus pentoxide.

EXAMPLE B-1-C

A salt is prepared by the procedure of Example B-1-A except that the amine is used tertiary-octyl primary amine.

EXAMPLE B-1-D

A salt is prepared by the procedure of Example B-1-A except that the partially esterified phosphoric acid used is derived from a mixture of 2 moles of octacontanyl alcohol and 1 mole of phosphorus pentoxide.

EXAMPLE B-1-E

A salt is prepared by the procedure of Example B-1-A except that the partially esterified phosphoric acid used is derived from a mixture of 3 moles of primary-pentyl alcohol and 1 mole of phosphorus pentoxide.

EXAMPLE B-1-F

Alfol 8-10 (2628 parts, 18 moles) is heated to a temperature of about 45° C. whereupon 852 parts (6 moles) of phosphorus pentoxide are added over a period of 45 minutes while maintaining the reaction temperature between about 45°–65° C. The mixture is stirred an additional 0.5 hour at this temperature, and is thereafter heated at 70° C. for about 2–3 hours. Primene 81-R (2362 parts, 12.6 moles) is added dropwise to the reaction mixture while maintaining the temperature between about 30°–50° C. When all of the amine has been added, the reaction mixture is filtered through a filter aid, and the filtrate is the desired amine salt containing 7.4% phosphorus (theory, 7.1%).

EXAMPLE B-1-G

To 1000 parts (3.21 moles) of an alkyl phosphoric acid ester mixture prepared as in Example B-1-F, there is added 454 parts (3.7 moles) of di-n-butyl amine and maintaining an atmosphere of nitrogen. Over the period of addition, the reaction mixture is heated to and maintained at a temperature of 120° C. After all of the butyl amine has been added, the mixture is maintained at 120° C. for 8 hours. The desired amine salt is obtained and contains 7.1% phosphorus (theory, 6.8%) and 3.4% nitrogen (theory, 3.6%).

EXAMPLE B-1-H

To 1000 parts (3.21 moles) of a phosphoric acid ester prepared as in Example B-1-F, there is added 260 parts (3.53 moles) of n-butyl amine dropwise as the temperature rises from 20° C. to about 70° C. The dropwise addition is completed in about 2 hours, and after completion of the addition, the mixture is heated to 140° C. and maintained at this temperature for 6 hours to yield the desired product. The product contains 8.4% phosphorus (theory, 7.9%) and 3.9% nitrogen (theory, 3.9%).

EXAMPLE B-1-I

To 721.4 parts (2.31 moles) of an alkyl phosphoric acid mixture as prepared in Example B-1-F, there is added 613.7 parts (2.54 moles) of di-(2-ethylhexylamine) in an atmosphere of nitrogen. As the amine is added, the temperature of the reaction mixture rises from 20° C. to 120° C. The reaction mixture is maintained at this temperature for 5 hours to yield the desired product containing 3.4% phosphorus (theory, 3.0%) and 2.7% nitrogen (theory, 2.7%).

EXAMPLE B-1-J

A reaction vessel is charged with 793.4 parts (9 moles) of n-amyl alcohol, and 426 parts (3 moles) of phosphorus pentoxide is added over a period of 1.5 hours incrementally while maintaining the reaction temperature between about 55°–70° C. After all of the phosphorus pentoxide has been added, the mixture is stirred for 0.5 hour. The reaction mixture then is maintained at 70° C. for 3 hours. Primene 81-R (1597.9 parts, 5.93 moles) is added dropwise to the reaction mixture while maintaining the temperature between 50°–70° C. After all of the Primene 81-R has been added, the reaction mixture is filtered through a filter aid to yield the desired amine salt containing 6.1% phosphorus (theory, 5.8%).

EXAMPLE B-1-K

To 1500 parts (4.81 moles) of the alkyl phosphoric acid mixture prepared as in Example B-1-F, there is added 1423.5 parts (5.29 moles) of Armeen O (oleyl amine) over a period of 2 hours in a nitrogen atmosphere. After all of the amine is added, the mixture is heated to 80° C. and maintained at this temperature for 3 hours to form the desired product containing 5.4% phosphorus (theory, 5.1%) and 2.5% nitrogen (theory, 2.5%).

EXAMPLE B-1-L n-Amyl alcohol (793.4 parts, 9.0 moles), is heated to 45° C. whereupon 426 parts (3 moles) of phosphorus pentoxide is added incrementally over a period of 1.5 hours while maintaining the reaction temperature between 60°–80° C. The mixture is stirred an additional 0.5 hour after all of the phosphorus pentoxide is added and thereafter at a temperature of 70° C. for 3 hours. Primene 81-R (1261.3 parts, 6.75 moles) is added dropwise while maintaining the temperature between 50°–70° C. After all of the amine has been added, the mixture is filtered through a filter aid to yield the desired amine salt containing 4.5% phosphorus (theory, 3.7%) under nitrogen content of 3.6% (theory, 3.8%).

EXAMPLE B-1-M

A mixture of 539.8 parts (3.7 moles) of Alfol 8-10 and 326 parts (3.7 moles) of n-amyl alcohol is prepared and heated to 30° C. whereupon 350 parts (2.46 moles) of phosphorus pentoxide are added incrementally utilizing a cold water bath to maintain the temperature of the reaction mixture at 50°–60° C. After all of the phosphorus pentoxide is added, the mixture is stirred an additional 0.5 hour and thereafter maintained at a temperature of 70° C. for 3 hours. The phosphoric acid mixture is cooled to about 40° C. whereupon 925.6 parts (4.95 moles) of Primene 81-R are added dropwise over a period of 2 hours. The reaction mixture is exothermic to 70° C., and after all of the amine is added, the mixture is filtered through a filter aid and the filtrate is the desired amine salt containing 5.5% phosphorus and 3.2% nitrogen (theory, 3.24%).

EXAMPLE B-1-N

A mixture of 400 parts (2.74 moles) of Alfol 8-10 and 400 parts (4.54 moles) of n-amyl alcohol is prepared, and 344.5 parts (2.43 moles) of phosphorus pentoxide is added incrementally while maintaining the temperature of the reaction at 50°–60° C. with a cooling bath. After all of the phosphorus pentoxide is added, the mixture is stirred for an additional 0.5 hour and thereafter stirred at 70° C. for a period of 3 hours. The phosphoric acid mixture is cooled to about 40° C. whereupon 897.1 parts (4.8 moles) of Primene 81-R are added dropwise over a period of 2 hours. An exothermic reaction to about 70° C. is observed, and the reaction mixture is stirred an additional hour. The reaction mixture then is filtered through a filter aid, and the filtrate is the desired amine salt containing 4.94% phosphorus (theory, 3.7%) and 3.3% nitrogen (theory, 3.3%).

EXAMPLE B-1-O

A mixture of 462.8 parts (3.17 moles) of Alfol 8-10 and 323.3 parts (3.17 moles) of 2-methyl-2-amyl alcohol is heated to about 30° C. whereupon 300 parts (2.11 moles) of phosphorus pentoxide is added incrementally using a cold water bath to maintain the reaction temperature between about 50°–60° C. The mixture is stirred an additional one-half hour after all of the phosphorus pentoxide is added and further heated at 70° C. for 3 hours. The phosphoric acid mixture is cooled to about 40° C., and 804.2 parts (4.29 moles) of Primene 81-R is added dropwise over a period of 2 hours. An exotherm to 70° C. is observed, and the mixture is stirred an additional hour and then filtered through a filter aid. The filtrate is the desired amine salt containing 4.45% phosphorus (theory, 3.5%) and 3.1% nitrogen (theory, 3.2%).

EXAMPLE B-1-P

A mixture of 350 parts of Alfol 8-10 alcohol (2.4 moles) and 350 parts (3.43 moles) of 2-methyl-2-amyl alcohol is prepared, and 276 parts (1.94 moles) of phosphorus pentoxide is added incrementally using a cold water bath to maintain the reaction temperature between 50°–60° C. with stirring. The mixture is stirred an additional one-half hour after all of the phosphorus pentoxide is added, and the mixture is then heated to 70° C. and maintained at this temperature for 3 hours. The phosphoric acid mixture is cooled to about 40° C., and 734 parts (3.91 moles) of Primene 81-R is added dropwise over a period of 2 hours. An exotherm to 70° C. is reserved and the mixture is stirred an additional hour and filtered. The filtrate is the desired amine salt containing 4.6% phosphorus (theory, 3.5%) and 3.2% nitrogen (theory, 3.2%).

EXAMPLE B-1-Q

A mixture of 322.8 parts (3.165 moles) of 4-methyl-2-amyl alcohol and 279 parts (3.165 moles) of n-amyl alcohol is prepared, and 300 parts (2.11 moles) of phosphorus pentoxide is added incrementally using a cold water bath to maintain the reaction temperature between 50°–60° C. The mixture is stirred an additional one-half hour after all of the phosphorus pentoxide is added, and thereafter, the mixture is heated to 70° C. and maintained at this temperature for 3 hours. The phosphoric acid mixture obtained is cooled to 40° C. whereupon 781.2 parts (4.18 moles) of Primene 81-R is added dropwise over a period of 2 hours. Exotherm to about 70° C. is observed and the material is stirred an additional hour and filtered. The filtrate is the desired amine salt containing 4.3% phosphorus (theory, 3.9%) and 3.5% nitrogen (theory, 3.5%).

EXAMPLE B-1-R

A reactor is charged with 6540 parts of 4-methyl-2-pentanol and is heated to 45° C. 3025 parts of $P_2O_5$ is added in 100–200 part increments over 5 hours. The exothermic reaction is maintained at 45°–65° C. The temperature is held at 70° C. for 2 hours. The reaction product is then filtered using a diatomaceous earth filter aid.

To 7 equivalents of the above product (based on an equivalent weight of 248 determined by a bromophenol blue neutralization number of 226 acid) is added 7 equivalents (based on theory N) of Primene-81R over 0.5 hours. The exothermic reaction is cooled to keep the temperature below 80° C. The mixture is then stirred for 2 hours at 60°–80° C. The unfiltered material is the product.

In addition to the amine salts of phosphoric and dithiophosphoric acids, the lubricating and functional fluids of the invention also may contain at least one (B-2) dihydrocarbyl-substituted phosphite characterized by the formula $$(RO)_2P(O)H \qquad (II)$$

wherein each R is independently a hydrocarbyl group and the R groups may be the same or different. In another embodiment, the total number of carbon atoms in the two R groups is at least about 4 carbon atoms. The phosphites improve the extreme pressure properties at high-torque, low-speed operating conditions.

The phosphites (II) are known compounds and many are available commercially or easily prepared. In one method of preparation, a low molecular weight dialkyl phosphite (e.g., dimethyl) is reacted with a higher molecular weight alcohol (e.g., decyl alcohol) and the decyl groups replace the methyl groups (analogous to classic transesterification) with the formation of methanol which is stripped from the reaction mixture.

The hydrocarbyl groups R in the phosphite (II) contain from about 1 to 30 carbon atoms. It is necessary, however, that the R groups be selected so that the phosphite is soluble in the lubricating compositions of the present invention. Generally, the R groups will contain at least about 4 carbon atoms and more preferably at least about 8 carbon atoms.

The R groups may be aliphatic or aromatic such as alkyl, aryl, alkaryl, aralkyl and alicyclic hydrocarbon groups. Examples of such R groups include, for example, ethyl, n-butyl, hexyl, 2-ethyl-hexyl, nonyl, dodecyl, stearyl, amyl phenyl, octyl phenyl, nonyl phenyl, methyl cyclohexyl, alkylated naphthyl, etc.

The preferred R groups are aliphatic and more particularly, primary aliphatic groups containing at least about 4 carbon atoms, and more generally at least about 8 carbon atoms. Accordingly, examples of the preferred R groups which are useful in the present invention include, 1-octyl, 1-decyl, 1-dodecyl, 1-tetradecyl, 1-hexadecyl, 1-octadecyl, oleyl, linoleyl, linolenyl, phytol, myricyl, lauryl, myristyl, cetyl, stearyl and behenyl.

Of course, the phosphites can be derived from commercial alcohols (including mixtures) and these commercial alcohols may comprise minor amounts of alcohols which, although not specified herein, do not detract from the major purposes of this invention. Higher synthetic monohydric alcohols of the type formed by the Oxo process (e.g., 2-ethyl-hexyl), the aldol condensation, or by organoaluminum-catalyzed oligomerization of alpha-olefins (especially ethylene), followed by oxidation, also are useful.

Examples of some preferred monohydric alcohols and alcohol mixtures useful in preparing the compositions of the invention include commercially available: "Alfol" alcohols marketed by Continental Oil Corporation; the Adol alcohols are marketed by Ashland Chemical; a variety of mixtures of monohydric fatty alcohols derived from naturally occurring triglycerides and ranging in chain length of from $C_8$ to $C_{18}$ available from Procter & Gamble Company; fatty vicinal diols such as those available from Ashland Oil under the general trade designation Adol 114 and Adol 158. Specific examples of these commercially available alcohol mixtures were discussed above with respect to the preparation of the phosphoric acids.

The following is an example of the preparation of a dihydrocarbylphosphite wherein the hydrocarbyl groups contain an average of from about 8 to 10 carbon atoms.

EXAMPLE B-2-A

A mixture of 1752 parts (12 moles) of Alfol 8-10 and 660 parts (6 moles) of dimethylphosphite is heated to about 120°–130° C. while sparging with nitrogen. The mixture is held at this temperature for about 8 hours while removing methanol as it is formed. The reaction mixture is vacuum stripped to 140° C. at 30 mm. Hg. The residue is filtered at about room temperature, and the filtrate is the desired product containing 10.3% phosphorus (theory, 9.2).

(C) Soluble Nitrogen-Containing Compositions

In addition to the amine salts (B-1), the lubricating and functional fluid compositions of the present invention also contain at least one soluble nitrogen-containing composition prepared by the reaction of a hydrocarbon-substituted succinic acid-producing compound (herein sometimes referred to as the "succinic acylating agent") with at least about one-half equivalent, per equivalent of acid-producing compound, of an amine containing at least one hydrogen attached to a nitrogen group. The nitrogen-containing compositions (C) obtained in this manner are usually complex mixtures whose precise composition is not readily identifiable. Thus, the compositions generally are described in terms of the method of preparation. The nitrogen-containing compositions are sometimes referred to herein as "acylated amines". The nitrogen-containing compositions (C) are either oil-soluble, or they are soluble in the oil-containing lubricating and functional fluids of this invention.

The soluble nitrogen-containing compositions useful as component (C) in the lubricating compositions of the present invention are known in the art and have been described in many U.S. patents including

| | | |
|---|---|---|
| 3,172,892 | 3,341,542 | 3,630,904 |
| 3,215,707 | 3,444,170 | 3,632,511 |
| 3,272,746 | 3,454,607 | 3,787,374 |
| 3,316,177 | 3,541,012 | 4,234,435 |

The above U.S. patents are expressly incorporated herein by reference for their teaching of the preparation of nitrogen-containing compositions useful as component (C).

In general, a convenient route for the preparation of the soluble nitrogen-containing compositions (C) comprises the reaction of a hydrocarbon-substituted succinic acid-producing compound ("carboxylic acid acylating agent") with an amine containing at least one hydrogen attached to a nitrogen atom (i.e., H—N=). The hydrocarbon-substituted succinic acid-producing compounds include the succinic acids, anhydrides, halides and esters. The number of carbon atoms in the hydrocarbon substituent on the succinic acid-producing compound may vary over a wide range provided that the nitrogen-containing composition (C) is soluble in the lubricating compositions of the present invention. Thus, the hydrocarbon substituent generally will contain an average of at least about 30 aliphatic carbon atoms and preferably will contain an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups as indicated above, and, providing that the polar groups are not present in proportion sufficiently large to significantly alter the hydrocarbon character of the substituent.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 3-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene, terpolymer of 80% of isobutene with 20% of 1-pentene and 20% of 1-octene; copolymer of 80% of 1-hexene and 20% of 1-heptene; terpolymer of 90% of isobutene with 2% of cyclohexene and 8% of propene; and copolymer of 80% of ethylene and 20% of propene.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefinic substances.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products of this invention. The use of such higher molecular weight olefin polymers often is desirable. Preferably the substituent is derived from a polyolefin characterized by an Mn value of about 700 to about 10,000, and an Mw/Mn value of 1.0 to about 4.0.

In preparing the substituted succinic acylating agents of this invention, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds.

One procedure for preparing the substituted succinic acylating agents of this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkene-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents of the invention utilizes a process described in U.S. Pat. No. 3,912,764 and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkylene. The direct alkylation step is conducted at temperatures of 180°-250° C. During the chlorine-introducing stage, a temperature of 160°-225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

Another process for preparing the substituted succinic acylating agents of this invention is the so-called "one-step" process. This process is described in U.S. Pat. Nos. 3,215,707 and 3,231,587. Both are expressly incorporated herein by reference for their teachings in regard to that process.

Basically, the one-step process involves preparing a mixture of the polyalkene and the maleic reactant containing the necessary amounts of both to provide the desired substituted succinic acylating agents of this invention. This means that there must be at least one mole of maleic reactant for each mole of polyalkene in order that there can be at least one succinic group for each equivalent weight of substituent groups. Chlorine is then introduced into the mixture, usually by passing chlorine gas through the mixture with agitation, while maintaining a temperature of at least about 140° C.

A variation of this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and perchlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160°-220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200°-210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

The molar ratio of polyalkene to maleic reactant preferably is such that there is at least about one mole of maleic reactant for each mole of polyalkene. This is necessary in order that there can be at least 1.0 succinic group per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

The amines which are reacted with the succinic acid-producing compounds to form the nitrogen-containing compositions (C) may be monoamines and polyamines. The monoamines and polyamines must be characterized by the presence within their structure of at least one H—$\equiv$ group. Therefore, they have at least one primary (i.e., $H_2N$—) or secondary amino (i.e., H—N$\equiv$) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$— where X is —O— or —S—). In general, the amine of (C) may be characterized by the formula $$R_1R_2NH$$

wherein $R_1$ and $R_2$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R_1$ and $R_2$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocylic-substituted aliphatic amines, include 2-(cyclohexyl)-ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines suitable as (a) include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(para-methylphenyl)amine, naphthylamine, N-(n-butyl)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The polyamines from which (C) is derived include principally alkylene amines conforming for the most part to the formula

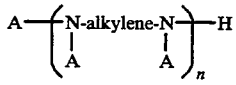

wherein n is an integer preferably less than about 10, A is a hydrogen group or a substantially hydrocarbon group preferably having up to about 30 carbon atoms, and the alkylene group is preferably a lower alkylene group having less than about 8 carbon atoms. The alkylene amines include principally methylene amines, ethylene amines, butylene amines, propylene amines, pentylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk and Othmer, Vol. 5, pp. 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N,N'-bis(2-hydroxyethyl)ethylene diamine, 1-(2-hydroxyethyl)piperazine, monohydroxypropyl-substituted diethylene triamine, 1,4-bis(2-hydroxypropyl)piperazine, di-hydroxypropyl-substituted tetraethylene pentamine, N-(3-hydroxypropyl)tetramethylene diamine, and 2-heptadecyl-1-(2-hydroxyethyl)imidazoline.

Higher homologues such as are obtained by condensation of the above illustrated alkylene amines or hydroxy alkyl-substituted alkylene amines through amino radicals or through hydroxy radicals are likewise useful. It will be appreciated that condensation through amino radicals results in a higher amine accompanied with removal of ammonia and that condensation through the hydroxy radicals results in products containing ether linkages accompanied with removal of water.

Heterocyclic mono- and polyamines can also be used in making the nitrogen-containing compositions (C). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The 5- and 6-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

The nitrogen-containing composition (C) obtained by reaction of the succinic acid-producing compounds and the amines described above may be amine salts, amides, imides, imidazolines as well as mixtures thereof. To prepare the nitrogen-containing composition (C), one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present. Thus, octyl amine has an equivalent weight equal to its molecular weight; ethylene diamine has an equivalent weight equal to one-half its molecular weight; and aminoethyl piperazine has an equivalent weight equal to one-third its molecular weight. The number of equivalents of succinic acid-producing compound depends on the number of carboxylic functions present in the hydrocarbon-substituted succinic acid-producing compound. Thus, the number of equivalents of hydrocarbon-substituted succinic acid-producing compound will vary with the number of succinic groups present therein, and generally, there are two equivalents of acylating reagent for each succinic group in the acylating reagents. Conventional techniques may be used to determine the number of carboxyl functions (e.g., acid number, saponification number) and, thus, the number of equivalents of acylating reagent available to react with amine. Additional details and examples of the procedures for preparing the nitrogen-containing compositions of the present invention by reaction of succinic acid-producing compounds and amines are included in, for example, U.S. Pat. Nos. 3,172,892; 3,219,666; 3,272,746; and 4,234,435, the disclosures of which are hereby incorporated by reference.

The nitrogen-containing composition (C) useful in the lubricating compositions of the present invention may also contain boron. The nitrogen- and boron-containing compositions are prepared by the reaction of (C-1) at least one boron compound selected from the class consisting of boron trioxides, boron halides, boron acids, boron amides and esters of boron acids with (C-2) at least one soluble acylated nitrogen intermediate prepared by the reaction of a hydrocarbon substituted succinic acid-producing compound (acylating agent) with at least about one-half equivalent, per equivalent of acid-producing compound, of an amine containing at least one hydrogen attached to a nitrogen atom.

The acylated nitrogen intermediate (C-2) described above is identical to the oil-soluble nitrogen-containing compositions (C) described above which have not been reacted with a boron compound. The amount of boron compound reacted with the oil-soluble acylated nitrogen intermediate (C-2) generally is sufficient to provide from about 0.1 atomic proportion of boron for each mole of the acylated nitrogen composition up to about 10 atomic proportions of boron for each atomic proportion of nitrogen of said acylated nitrogen composition. More generally the amount of boron compound present is sufficient to provide from about 0.5 atomic proportion of boron for each mole of the acylated nitrogen composition to about 2 atomic proportions of boron for each atomic proportion of nitrogen used.

The boron compounds useful in the present invention include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylene chlorohydrin, o-chlorophenol, m-nitrophenol, 6-bromo-octanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The reaction of the acylated nitrogen intermediate with the boron compounds can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

The reaction of the acylated nitrogen compositions with the boron compounds results in a product containing boron and substantially all of the nitrogen originally present in the nitrogen reactant. It is believed that the reaction results in the formation of a complex between boron and nitrogen. Such complex may involve in some instances more than one atomic proportion of boron with one atomic proportion of nitrogen and in other instances more than one atomic proportion of nitrogen with one atomic proportion of boron. The nature of the complex is not clearly understood.

Inasmuch as the precise stoichiometry of the complex formation is not known, the relative proportions of the reactants to be used in the process are based primarily upon the consideration of utility of the products for the purposes of this invention. In this regard, useful products are obtained from reaction mixtures in which the reactants are present in relative proportions as to provide from about 0.1 atomic proportions of boron for each mole of the acylated nitrogen composition used to about 10 atomic proportions of boron for each atomic proportion of nitrogen of said acylated nitrogen composition used. The preferred amounts of reactants are such as to provide from about 0.5 atomic proportion of boron for each mole of the acylated nitrogen composition to about 2 atomic proportions of boron for each atomic proportion of nitrogen used. To illustrate, the amount of a boron compound having one boron atom per molecule to be used with one mole of an acylated nitrogen composition having five nitrogen atoms per molecule is within the range from about 0.1 mole to about 50 moles, preferably from about 0.5 mole to about 10 moles.

The following examples are illustrative of the process for preparing the nitrogen-containing and the nitrogen- and boron-containing compositions useful in this invention:

EXAMPLE C-1

A polyisobutenyl succinic anhydride is prepared by the reaction of a chlorinated polyisobutylene with maleic anhydride at 200° C. The polyisobutenyl group has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction caused the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE C-2

The procedure of Example C-1 is repeated using 31 grams (1 equivalent) of ethylene diamine as the amine reactant. The nitrogen content of the resulting product is 1.4%.

EXAMPLE C-3

The procedure of Example C-1 is repeated using 5.5 grams (1.5 equivalents) of an ethylene amine mixture having a composition corresponding to that of triethylene tetramine. The resulting product has a nitrogen content of 1.9%.

EXAMPLE C-4

The procedure of Example C-1 is repeated using 55.0 grams (1.5 equivalents) of triethylene tetramine as the amine reactant. The resulting product has a nitrogen content of 2.9%.

EXAMPLE C-5

To a mixture of 140 grams of toluene and 400 grams (0.78 equivalent) of a polyisobutenyl succinic anhydride (having an acid number of 109 and prepared from maleic anhydride and the chlorinated polyisobutylene of Example C-1) there is added at room temperature 63.6 grams (1.55 equivalents) of a commercial ethylene amine mixture having an average composition corresponding to that of tetraethylene pentamine. The mixture is heated to distill the water-toluene azeotrope and then to 150° C. at reduced pressure to remove the remaining toluene. The residual polyamide has a nitrogen content of 4.7%.

EXAMPLE C-6

A polyisobutenyl succinic anhydride having an acid number of 105 and an equivalent weight of 540 is prepared by the reaction of a chlorinated polyisobutylene (having an average molecular weight of 1050 and a chlorine content of 4.3%) and maleic anhydride. To a mixture of 300 parts by weight of the polyisobutenyl succinic anhydride and 160 parts by weight of mineral oil there is added at 65°–95° C. an equivalent amount (25 parts by weight) of the commercial ethylene amine mixture of Example C-5. This mixture then is heated to 150° C. to distill all of the water formed in the reaction. Nitrogen is bubbled through the mixture at this temperature to insure removal of the last traces of water. The residue is diluted by 79 parts by weight of mineral oil and this oil solution found to ahve a nitrogen content of 1.6%.

EXAMPLE C-7

A polypropylene-substituted succinic anhydride having an acid number of 84 is prepared by the reaction of a chlorinated polypropylene having a chlorine content of 3% and molecular weight of 1200 with maleic anhydride. A mixture of 813 grams of the polypropylene-substituted succinic anhydride, 50 grams of a commercial ethylene amine mixture having an average composition corresponding to that of tetraethylene pentamine and 566 grams of mineral oil is heated at 150° C. for 5 hours. The residue is found to have a nitrogen content of 1.18%.

EXAMPLE C-8

An acylated nitrogen composition is prepared according to the procedure of Example C-1 except that the reaction mixture consists of 3880 grams of the polyisobutenyl succinic anhydride, 376 grams of a mixture of triethylene tetramine and diethylene triamine (75:25 weight ratio), and 2785 grams of mineral oil. The product is found to have a nitrogen content of 2%.

EXAMPLE C-9

An acylated nitrogen composition is prepared according to the procedure of Example C-1 except that the reaction mixture consists of 1385 grams of the polyisobutenyl succinic anhydride, 179 grams of a mixture of triethylene tetramine and diethylene triamine (75:25 weight ratio), and 1041 grams of mineral oil. The product is found to have a nitrogen content of 2.55%.

EXAMPLE C-10

An acylated nitrogen composition is prepared according to the procedure of Example C-7 except that the polyisobutene-substituted succinic anhydride of Example C-1 (1 equivalent for 1.5 equivalents of the amine reactant) is substituted for the polypropylene-substituted succinic anhydride used.

EXAMPLE C-11

An acylated nitrogen composition is prepared according to the procedure of Example C-7 except that the polyisobutene-substituted succinic anhydride of Example C-1 (1 equivalent for 2 equivalents of the amine reactant) is substituted for the polypropylene-substituted succinic anhydride used.

EXAMPLE C-12

An acylated nitrogen composition is prepared according to the procedure of Example C-4 except that the commercial ethylene amine mixture (1.5 equivalent per equivalent of the anhydride) of Example C-6 is substituted for the triethylene tetramine used.

EXAMPLE C-13

An acylated nitrogen composition is prepared according to the procedure of Example-C-7 except that the polyisobutene-substituted succinic anhydride of Example C-1 (1 equivalent for 1 equivalent of the amine reactant) is substituted for the polypropylene-substituted succinic anhydride. The composition is found to have a nitrogen content of 1.5%.

EXAMPLE C-14

A mixture of 510 parts (0.28 mole) of polyisobutene (Mn=1845; Mw=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent at 130° C. The reaction mixture is heated to 150° C. in 2 hours and stripped by blowing with nitrogen. The reaction mixture is filtered to yield the filtrate as an oil solution of the desired product.

EXAMPLE C-15

A mixture of 1000 parts (0.495 mole) of polyisobutene (Mn=2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C., an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent at 140°-145° C. The reaction mixture is heated to 155° C. in 3 hours and stripped by blowing with nitrogen. The reaction mixture is filtered to yield the filtrate as an oil solution of the desired product.

EXAMPLE C-16

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example C-15 at 140° C. The reaction mixture is heated to 150° C. in 1.8 hours and stripped by blowing with nitrogen. The reaction mixture is filtered to yield the filtrate as an oil solution of the desired product.

EXAMPLE C-17

To 600 grams (1 atomic proportion of nitrogen) of the acylated nitrogen composition prepared according to the process of Example C-13 there is added 45.5 grams (0.5 atomic proportion of boron) of boron trifluoride-diethyl ether complex (1:1 molar ratio) at 60°-75° C. The resulting mixture is heated to 103° C. and then at 110° C./30 mm. to distill off all volatile components. The residue is found to have a nitrogen content of 1.44% and a boron content of 0.49%.

EXAMPLE C-18

A mixture of 62 grams (1 atomic proportion of boron) of boric acid and 1645 grams (2.35 atomic proportions of nitrogen) of the acylated nitrogen composition obtained by the process of Example C-8 is heated at 150° C. in nitrogen atmosphere for 6 hours. The mixture is then filtered and the filtrate is found to have a nitrogen content of 1.94% and a boron content of 0.33%.

EXAMPLE C-19

An oleyl ester of boric acid is prepared by heating an equi-molar mixture of oleyl alcohol and boric acid in toluene at the reflux temperature while water is removed azeotropically. The reaction mixture is then heated to 150° C./20 mm. and the residue is the ester having a boron content of 3.2% and a saponification number of 62. A mixture of 344 grams (1 atomic proportion of boron) of the ester and 1645 grams (2.35 atomic proportions of nitrogen) of the acylated nitrogen composition obtained by the process of Example C-8 is heated at 150° C. for 6 hours and then filtered. The filtrate is found to have a boron content of 0.6% and a nitrogen content of 1.74%.

EXAMPLE C-20

A mixture of 372 (6 atomic proportions of boron) of boric acid and 3111 grams (6 atomic proportions of nitrogen) of the acylated nitrogen composition obtained by the process of Example C-11 is heated at 150° C. for 3 hours and then filtered. The filtrate is found to have a boron content of 1.64% and a nitrogen content of 2.56%.

EXAMPLE C-21

Boric acid (124 grams, 2 atomic proportions of boron) is added to the acylated nitrogen composition (556 grams, 1 atomic proportion of nitrogen) obtained according to the procedure of Example C-11. The resulting mixture is heated at 150° C. for 3.5 hours and filtered at that temperature. The filtrate is found to have a boron compound of 3.23% and a nitrogen content of 2.3%.

EXAMPLE C-22

A mixture of 62 parts of boric acid and 2720 parts of the oil solution of the product prepared in Example C-15 is heated at 150° C. under nitrogen for 6 hours. The reaction mixture is filtered to yield the filtrate as an oil solution of the desired boron-containing product.

EXAMPLE C-23

An oleyl ester of boric acid is prepared by heating an equimolar mixture of oleyl alcohol and boric acid in toluene at the reflux temperature while water is removed azeotropically. The reaction mixture is then heated to 150° C. under vacuum and the residue is the ester having a boron content of 3.2% and a saponification number of 62. A mixture of 344 parts of the heater and 2720 parts of the oil solution of the product prepared in Example C-15 is heated at 150° C. for 6 hours and then filtered. The filtrate is an oil solution of the desired boron-containing product.

EXAMPLE C-24

Boron trifluoride (34 parts) is bubbled into 2190 parts of the oil solution of the product prepared in Example C-16 at 80° C. within a period of 3 hours. The resulting mixture is blown with nitrogen at 70°–80° C. for 2 hours to yield the residue as an oil solution of the desired product.

EXAMPLE C-25

To 1000 parts of poly(isobutene) substituted succinic anhydride (which is prepared by the "one-step" procedure of U.S. Pat. No. 3,215,707) having a saponification number of 108 is added 147 parts of an ethylene polyamien having an empirical formula that corresponds to pentaethylene hexamine, and 275 parts mineral oil. The reaction is begun at 90° C. and the temperature is increased to 121° C. with nitrogen blowing. The reaction mixture is stripped of volatile materials by heating to 150° C. The residue is filtered.

EXAMPLE C-26

A slurry of 239 parts boric acid in 398 parts mineral oil is reacted with 1405 parts of the product of Example C-25. The reaction is conducted starting at 90° C. and the temperature is increased to 150° C. over 3 hours followed by nitrogen blowing at 150°–155° C. The reaction mixture is filtered.

Generally, the lubricants and functional fluids of the present invention contain an amount of the amine salt (B-1) and nitrogen-containing composition (C) to provide the lubricants and functional fluids with the desired properties such as improved high temperature stability. Normally, this amount will be from about 0.1 to about 10% by weight of the combination of (B-1) and (C) and preferably from about 0.25 to about 7.5% of the total weight of the fluid. The relative amounts of amine salt (B-1) and nitrogen-containing composition (C) contained in the lubricant may vary over a wide range although the weight ratio of (B-1):(C) generally is from about 0.1:1 to about 10:1. In a more preferred embodiment, the weight ratio (B-1):(C) is from about 0.5:1 to about 5:1. Similarly, the amount of the phosphite (B-2) contained in the lubricating composition may vary over a wide range, and the preferred amounts can be determined readily by one skilled in the art.

The invention also contemplates the use of other additives in the lubricating and functional fluid compositions of this invention. Such additives include, for example, detergents and dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of relatively high molecular weight aliphatic or alicyclic halides with amines, preferably oxyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(2) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(3) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |

-continued

| | | | |
|---|---|---|---|
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion-and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phospho-sulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

A particularly effective lubricant for gear assemblies or differentials consists of the compositions of this invention and a substantially hydrocarbon polysulfide. Lubricants containing such additives are characterized by the ability to provide effective lubrication in changing operating environment wherein shock load, high speed, and high torque demands are made cyclically or in sequence on the lubricant.

Substantially hydrocarbon polysulfides especially useful for this purpose include principally aliphatic, cycloaliphatic, and aromatic disulfides, trisulfides, tetrasulfides, pentasulfide, or higher polysulfides. The term "polysulfide" as used herein designates compounds in which two substantially hydrocarbon radicals are joined to a group consisting of at least 2 sulfur atoms. Such polysulfides are represented, for the most part, by any of the structural formulas below.

$$R''-S-Sn-R''; \quad R''-\underset{\underset{Sn}{|}}{S}-R''; \quad R''-\overset{\overset{Sn}{|}}{\underset{\underset{Sn}{|}}{S}}-R''$$

wherein R'' is a substantially hydrocarbon radical such as illustrated previously and n is an integer preferably less than 6. The nature of the linkage between the sulfur atoms is not clearly understood, although it is believed that such linkage may be described by a single covalent bond, a double bond, or a coordinate covalent bond.

Polysulfides preferred for use herein are alkyl polysulfides, cycloalkyl polysulfides or polysulfides having a mixture of such hydrocarbon radicals. The polysulfides containing at least about 6 carbon atoms per molecule have greater oil solubility and are generally preferred. Specific examples of such polysulfides are diisobutyl trisulfide,
diisopentyl trisulfide,
di-n-butyl tetrasulfide,
dicyclopentyl disulfide,
di-methylcyclohexy tetrasulfide,
di-2-ethylcyclopentyl disulfide,
dipentyl trisulfide,
beta-pinyl pentasulfide,
dibenzyl trisulfide,
benzyl iso-octyl disulfide,
diphenyl disulfide,
cyclohexyl cyclopentyl trisulfide,
alpha-butyl-beta-naphthyl trisulfide,
bis(polyisobutene (molecular weight of 100)-substituted-phenyl) disulfide,
di-tolyl disulfide,
di-paraffin wax trisulfide,
di-terpenyl disulfide,
bis(o,p-diisopropylphenyl) tetrasulfide,
didodecyl trisulfide,
dibehenyl trisulfide, and
isobutyl cyclohexyl tetrasulfide.

Other polysulfides such as polar substituted polysulfides are exemplified by di(p-chlorobenzyl) disulfide, di-(omega-bromopentyl) trisulfide, di(p-butoxyphenyl) disulfide, and di(o-nitro-p-heptylphenyl) disulfide.

The preparation of the polysulfides may be accomplished by any of the various processes which are known and disclosed in the art including, for example, the reaction of a sulfur and halogen containing hydrocarbon, prepared, for example, by the reaction of an olefin with a sulfur halide such as sulfur monochloride, with an alkali metal sulfide or polysulfide, the reaction of a mercaptan or a thiophenol with sulfur and/or sulfur halide, the reaction of saturated and unsaturated hydrocarbons with sulfur and/or sulfur halide, the reaction of a hydrocarbon monosulfide with sulfur, etc.

Sulfur-containing compositions prepared by the sulfurization of olefins are particularly useful in improving the anti-wear, extreme pressure and antioxidant properties of the lubricating oil compositions. When included in the oil compositions of this invention, the oil composition typically will contain from about 0.01 to about 2% of the sulfurized olefin. The olefins may be any aliphatic, arylaliphatic or alicyclic olefinic hydrocarbon containing from about 3 to about 30 carbon atoms. The olefinic hydrocarbons contain at least one olefinic double bond, which is defined as a non-aromatic double bond; that is, one connecting two aliphatic carbon atoms. In its broadest sense, the olefinic hydrocarbon may be defined by the formula $$R^7R^8C{=}CR^9R^{10}$$

wherein each of $R^7$, $R^8$, $R^9$ and $R^{10}$ is hydrogen or a hydrocarbon (especially alkyl or alkenyl) radical. Any two of $R^7$, $R^8$, $R^9$ and $R^{10}$ may also together form an alkylene or substituted alkylene group; i.e., the olefinic compound may be alicyclic.

Monoolefinic and diolefinic compounds, particularly the former, are preferred, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3–20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.5–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature and the vapor pressure of the reactants and products an it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.01–2.0% of the weight of the olefinic compound. In the case of the preferred ammonia and amine catalyst, about 0.0005–0.5 mole per mole of olefin is preferred, and about 0,001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of the sulfurized olefins is th treatment of the sulfurized product, obtained as described hereinabove, to reduce active sulfur. An illustrative method is treatment with an alkali metal sulfide. Other optional treatments may be employed to remove insoluble by-products and improve such qualities as the odor, color and staining characteristics of the sulfurized compositions.

U.S. Pat. No. 4,119,549 is incorporated by reference herein for its disclosure of suitable sulfurized olefins useful in the lubricating oils of the present invention. Several specific sulfurized compositions are described in the working examples thereof. The following examples illustrate the preparation of two such compositions.

EXAMPLE S-1

Sulfur (629 parts, 19.6 moles) is charged to a jacketed high-pressure reactor which is fitted with agitator and internal cooling coils. Refrigerated brine is circulated through the coils to cool the reactor prior to the introduction of the gaseous reactants. After sealing the reactor, evacuating to about 6 torr and cooling, 1100 parts (9.6 moles) of isobutene, 334 parts (9.8 moles) of hydrogen sulfide and 7 parts of n-butylamine are charged to the reactor. The reactor is heated, using steam in the external jacket, to a temperature of about 171° C. over 1.5 hours. A maximum pressure of 720 psig is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

EXAMPLE S-2

Following substantially the procedure of Example S-1, 773 parts of diisobutene are reacted with 428.6 parts of sulfur and 143.6 parts of hydrogen sulfide in the presence of 2.6 parts of n-butylamine, under autogenous pressure at a temperature of about 150°–155° C. Volatile materials are removed and the sulfurized product is recovered as a liquid.

Other useful sulfurized olefins, and methods for preparing same are described in U.S. Pat. No. 3,267,003, U.S. Pat. No. 4,119,550, U.S. Pat. No. 4,191,659 and U.S. Pat. No. 4,344,854, each of which is expressly incorporated herein by reference for relevant disclosures contained therein.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialklyfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

The following examples illustrate the lubricant compositions of the invention.

| | Parts by Wt. |
|---|---|
| Lubricant A | |
| Base oil | 98 |
| Product of Example B-1-F | 1.00 |
| Product of Example C-1 | 1.00 |
| Lubricant B | |
| Base oil | 96.75 |
| Product of Example B-1-F | 1.25 |
| Product of Example C-17 | 2.00 |
| Lubricant C | |
| Base Oil | 97.50 |
| Product of Example B-1-H | 1.00 |
| Product of Example C-14 | 1.50 |
| Lubricant D | |
| Base oil | 95.90 |
| Product of Example B-1-F | 1.35 |
| Product of Example C-14 | 2.00 |
| Product of Example B-2-A | 0.75 |
| Lubricant E | |
| Base oil (SAE 90) | 92.64 |
| Product of Example B-1-F | 0.77 |
| Product of Example B-2-A | 0.59 |
| Product of Example C-26 | 2.0 |
| Product of Example S-1 | 2.0 |
| Reaction product of sulfo-chloro-hydrocarbon with sodium sulfide | 2.0 |
| Fatty amide | 0.09 |
| Tetraalkyl primary amine | 0.15 |
| Dimercaptothiadiazole derived corrosion inhibitor | 0.12 |
| Acrylate antifoam solution | 600 ppm |
| Lubricant F | |
| Base oil (SAE 90) | 94.5 |
| Product of Example B-1-R | 1.2 |
| Product of Example C-26 | 0.88 |
| Fatty amide | 0.10 |
| Product of Example S-1 | 3.20 |
| Dimercaptothiadiazole derived corrosion inhibitor | 0.09 |
| Acrylate antifoam solution | 600 ppm |
| Commercial poly-alkoxy demulsifier | 0.027 |
| Plexol 156 | 1.00 |
| Lubricant G | |
| Same as Lubricant F replacing 1.2 parts of product of Example B-1-R with 1.35 parts of product of Example B-1-F | |

The lubricant compositions of the present invention may be in the form of lubricating oils and greases in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantities of thickening agents and other additive components to provide desirable properties.

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmetic acid, myristic acid, cottonseed oil acids, and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Particularly useful thickening agents employed in the grease compositions are essentially hydrophilic in character, but which have been converted into a hydrophobic condition by the introduction of long chain hydrocarbon groups onto the surface of the clay particles prior to their use as a component of a grease composition, as, for example, by being subjected to a preliminary treatment with an organic cationic surface-active agent, such as an ammonium compound. Typical ammonium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3% to 15% by weight of the total grease composition.

Also included within this invention are methods for preparing aqueous compositions, including both concentrates and water-based functional fluids, containing other conventional additives commonly employed in water-based functional fluids. These methods comprise the steps of:

(1) mixing component (B-1) or a mixture of components (B-1) and (C) of the invention with such other conventional additives either simultaneously or sequentially to form a dispersion or solution; optionally (2) combining said dispersion or solution with water to form said aqueous concentrate; and/or (3) diluting said dispersion or solution, or concentrate with water wherein the total amount of water used is in the amount required to provide the desired concentration of the components of the invention and other functional additives in said concentrates or said water-based functional fluids.

These mixing steps are preferably carried out using conventional equipment and generally at room or slightly elevated temperatures, usually below 100° C. and often below 50° C. As noted above, the concentrate can be formed and then shipped to the point of use where it is diluted with water to form the desired water-based functional fluid. In other instances the finished water-based functional fluid can be formed directly in the same equipment used to form the concentrate or the dispersion or solution.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these if Triton X-100 which contains an average of 9–10 ethylene oxide unites per molecule, has an HLB value of about 13.5 and a molecular weight of about 628. Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this his regard.

As noted above, cationic, anionic and amphoteric surfactants can also be used. Generally, these are all hydrophilic surfactants. Anionic surfactants contain negatively charged polar groups while cationic surfactants contain positively charged polar groups. Amphoteric dispersants contain both types of polar groups in the same molecule. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anioinic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts. Amphoteric surfactants include amino acid-type materials and similar types. Various cationic, anionic and amphoteric dispersants are available from the industry, particularly from such companies as Rohm & Haas and Union Carbide Corporatino, both of America. Further information about anionic and cationic surfactants also can be found in the texts "Anionic Surfactants", Parts II and III, edited by W. M. Linfied, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

These surfactants, when used, are generally employed in effective amounts to aid in the dispersal of the various additives, particularly the functional additives discussed below, in the concentrates and water-based functional fluids of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickener for thickening said compositions. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener is used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

These thickeners can also be synthetic thickening polymers. Many such polymers are known to those of skill in the art. Representative of them are polyacrylates, polyacrylamides, hydrolyzed vinyl esters, water-soluble homo- and interpolymers of acrylamidoalkane sulfonates containing at least 50 mole percent of acrylamido alkane sulfonate and other comonomers such as acrylonitrile, styrene and the like. Poly-n-vinyl pyrrolidones, homo- and copolymers as well as water-soluble salts of styrene, maleic anhydride and isobutylene maleic anhydride copolymers can also be used as thickening agents.

Other useful thickeners are known to those of skill in the art any many can be found in the list in the aforementioned McCutcheon Publication: "Functional Materials", 1976, pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride represented by the formula

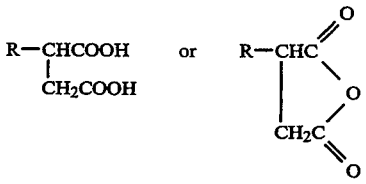

wherein R is a hydrocarbyl group of from about 8 to about 40 carbon atoms, with at least one water-dispersible amine terminated poly(oxyalkylene) or at least one water-dispersible hydroxy-terminated polyoxyalkylene. R preferably has from about 8 to about 30 carbon atoms, more preferably from about 12 to about 24 carbon atoms, still more preferably from about 16 to about 18 carbon atoms. In a preferred embodiment, R is represented by the formula

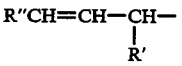

wherein R′ and R″ are independently hydrogen or straight chain or substantially straight chain hydrocarbyl groups, with the provise that the total number of carbon atoms in R is within the above-indicated ranges. Preferably R′ and R″ are alkyl or alkenyl groups. In a particularly advantageous embodiment, R has from about 16 to about 18 carbon atoms, R′ is hydrogen or an alkyl groups of from 1 to about 7 carbon atoms or an alkenyl groups of from 2 to about 7 carbon atoms, and R″ is an alkyl or alkenyl groups of from about 5 to about 15 carbon atoms.

The water-dispersible amine terminated poly(oxyalkylene)s are preferably alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxyalkylene) can also be a urea condensate of such alpha omega diamino poly(oxyethylene)s, alpha omega diamino poly(oxypropylene) poly(oxyethylene) poly-(oxypropylene)s or alpha omega diamino propylene oxide capped poly(oxyethylene)s. The amine-terminated poly(oxyalkylene) can also be a polyamino (e.g., triamino, tetramino, etc.) polyoxyalkylene provided it is amine-terminated and it is water-dispersible.

Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. Examples of these compounds include the hydroxy-terminated polyoxyalkylenes which are represented by the formula

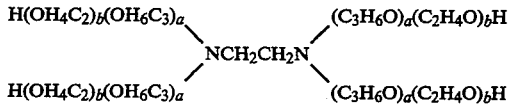

wherein a and b are integers such that the collective molecular weight of the oxypropylene chains range from about 900 to about 25,000, and the collective weight of the oxyethylene chains constitute from about 20% to about 90%, preferably from about 25% to about 55% by weight of the compound. These compounds are commercially available from BASF Wyandotte Corporation under the tradename "Tetronic". Additional examples include the hydroxy-terminated polyoxyalkylenes represented by the formula

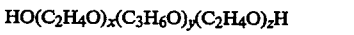

wherein y is an integer such that the molecular weight of the oxypropylene chain is at least about 900, and x and z are integers such that the collective weight of the oxyethylene chains constitute from about 20% to about 90% by weight of the compound. These compounds preferably have a molecular weight in the range of about 1100 to about 14,000. These compounds are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the carboxylic agent and the amine-or hydroxy-terminated polyoxyalkylene can be carried out at a temperature ranging from the highest of the melt temperatures of the reaction components up to the lowest of the decomposition temperatures of the reaction components or products. Generally, the reaction is carried out at a temperature in the range of about 60° C. to about 160° C., preferably about 120° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The weight of an equivalent of the carboxylic agent can be determined by dividing its molecular weight by the number of carboxylic functions present. The weight of an equivalent of the amine-terminated polyoxyalkylene can be determined by dividing its molecular weight by the number of terminal amine groups present. The weight of an equivalent of the hydroxy-terminated polyoxyalkylene can be determined by dividing its molecular weight by the number of terminal hydroxyl groups present. The number of terminal amine and hydroxyl groups can usually be determined from the structural formula of the polyoxyalkylene or empirically through well-known procedures. The amide/acids and ester/acids formed by the reaction of the carboxylic agent and amine-terminated or hydroxy-terminated polyoxyalkylene can be neutralized with, for example, one or more alkali metals, one or more amines, or a mixture thereof, and thus converted to amide/salts or ester/salts, respectively. Additionally, if these amide/acids or ester/acids are added to concentrates or functional fluids containing alkali metals or amines, amide/salts or ester/salts usually form, in situ.

South African Patent 85/0978 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above under the subtitle "Surfactants" can be used in this regard. When such surfactants are used, the weight ration of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two o more of the above-mentioned ways; for example, extreme pressure agents often function as load-carrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These functional additives can also include certain solid lubricants such a graphite, molybdenum disulfide and polytetraflroethylene and related solid polymers.

These functional additives can also include frictional polymer formers. Briefly, these are potential polymer forming materials which are dispersed in a liquid carrier at low concentration and which polymerize at rubbing or contacting surfaces to form protective polymeric films on the surfaces. The polymerizations are believed to result from the heat generated by the rubbing and, possibly, from catalytic and/or chemical action of the freshly exposed surface. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts or organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates; as well as dibutyl tin sulfide, tributyl tin oxide, phosphates and phosphites; borate amine salts, chlorinated waxes, trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, Ohio, U.S.A. These references are hereby incorporated by reference for their disclosures of functional additives useful in the compositions of this invention.

In certain of the typical aqueous compositions of the invention, the functional additive is a sulfur or chlorosulfur extreme pressure agent, known to be useful in oil-base systems. Such materials include chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenol dithiocarbamate; and Group II metal salts of phosphorodithioic acid, such as zinc dicyclohexyl phosphorodithioate, and the zinc salts of a phosphorodithioic acid.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Specific examples of functional additives useful in the aqueous systems of this invention include the following commercially available products.

TABLE I

| Functional Additive Tradename | Chemical Description | Supplier |
|---|---|---|
| Anglamol 32 | Chlorosulfurized hydrocarbon | Lubrizol[1] |
| Anglamol 75 | Zinc dialkyl phosphate | Lubrizol[1] |
| Molyvan L | A thiaphosphomolybdate | Vanderbilt[2] |
| Lubrizol-5315 | Sulfurized cyclic carboxylate ester | Lubrizol[1] |
| Emcol TS 230 | Acid phosphate ester | Witco[3] |

[1]The Lubrizol Corporation, Wickliffe, Ohio, U.S.A.
[2]R. T. Vanderbilt Company, Inc., New York, N.Y., U.S.A.
[3]Witco Chemical Corp., Organics Division, Houston, Texas U.S.A.

Mixtures of two or more of any of the aforedescribed functional additives can also be used.

Typically, a functionally effective amount of the functional additive is present in the aqueous compositions of this invention.

The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The aqueous systems of this invention often contain at least one inhibitor for corrosion of metals. These inhibitors can prevent corrosion of either ferrous or non-ferrous metals (e.g., copper, bronze, brass, titanium, aluminum and the like) or both. The inhibitor can be organic or inorganic in nature. Usually it is sufficiently soluble in water to provide a satisfactory inhibiting action though it can function as a corrosion-inhibitor without dissolving in water, it need not be water-soluble. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors is hereby incorporated by reference. Specific examples of useful inorganic inhibitors include alkali metal nitrites, sodium di- and tripolyphosphate, potassium and dipotassium phosphate, alkali metal borate and mixtures of the same. Many suitable organic inhibitors are known to those of skill in the art. Specific examples include hydrocarbyl amine and hydroxy-substituted hydrocarbyl amine neutralized acid compound, such as neutralized phosphates and hydrocarbyl phosphate esters, neutralized fatty acids (e.g., those having about 8 to about 22 carbon atoms), neutralized aromatic carboxylic acids (e.g., 4-tertiarybutyl benzoic acid), neutralized naphthenic acids and neutralized hydrocarbyl sulfonates. Mixed salt esters of alkylated succinimides are also useful. Particularly useful amines include the alkanol amines such s ethanol amine, diethanolamine. Mixtures of two or more of any of the aforedescribed corrosion-inhibitors can also be used. The corrosion-inhibitor is usually present in concentrations in which they are effective in inhibiting corrosion of metals with which the aqueous composition comes in contact.

Certain of the aqueous systems of the present invention (particularly those that are used in cutting or shaping of metal) can also contain at least one polyol with inverse solubility in water. Such polyols are those that become less soluble as the temperature of the water increases. They thus can function as surface lubricity agents during cutting or working operations since, as the liquid is heated as a result of friction between a metal workpiece and worktool, the polyol of inverse solubility "plates out" onto he surface of the workpiece, thus improving its lubricity characteristics.

The aqueous systems of the present invention can also include at least one bactericide. Such bactericides are well known to those of skill in the art and specific examples can be found in the aforementioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating or functional fluid composition having improved high temperature stability comprising (A) a major amount of an oil of lubricating viscosity, and a minor amount of (B-1) at least one soluble tertiary aliphatic primary amine salt of a substituted phosphoric acid composition characterized by the formula

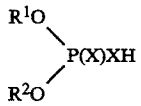

(I)

wherein $R^1$ is hydrogen or an aliphatic hydrocarbyl group, $R^2$ is an aliphatic hydrocarbyl group, and both X groups are either O or S, and (C) at least one soluble nitrogen- and boron-containing compound prepared by the reaction of (C-1) at least one boron compound selected from the class consisting of boron trioxide, boron halides, boron acids, boron anhydrides, boron amides and esters of boron acids with (C-2) at least one soluble acylated nitrogen intermediate prepared by the reaction of a hydrocarbon-substituted succinic acid-producing compound with at least about one-half equivalent, per equivalent of acid producing compound, of an amine containing at least one hydrogen attached to a nitrogen atom.

2. The composition of claim 1 wherein the primary amine contains from about 4 to about 30 carbon atoms.

3. The composition of claim 1 wherein both X groups are oxygen.

4. The composition of claim 1 wherein the hydrocarbyl groups are primary aliphatic groups.

5. The composition of claim 1 wherein the phosphoric acid composition of (B-1) comprises a mixture of substituted phosphoric acids prepared by the reaction of at least one hydroxy compound with a phosphorus reactant of the formula $P_2X_5$.

6. The composition of claim 5 wherein X is O.

7. The composition of claim 1 wherein $R^1$ and $R^2$ contain a total of at least about 4 carbon atoms.

8. The composition of claim 1 wherein the total number of carbon atoms in $R^1$ and $R^2$ is from about 4 to about 60.

9. The composition of claim 1 also containing at least one (B-2) di-hydrocarbyl-substituted phosphite characterized by the formula $$(RO)_2P(O)H \qquad (II)$$

wherein each R is a hydrocarbyl group which may be the same or different.

10. The composition of claim 1 wherein the succinic acid-producing compound of (C-2) contains an average of at least about 50 aliphatic carbon atoms in the substituent.

11. The composition of claim 1 wherein the succinic acid-producing compound of (C-2) is selected from the group consisting of succinic acids, anhydrides, esters and halides.

12. The composition of claim 1 wherein the hydrocarbon substituent of the succinic acid-producing compound of (C-2) is derived from a polyolefin having an Mn value within the range of from about 700 to about 10,000.

13. The composition of claim 12 wherein the polyolefin is a polyisobutene.

14. The composition of claim 1 wherein the amine of (C-2) is characterized by the formula $$R_1R_2NH$$

wherein $R_1$ and $R_2$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups, provided that only one of $R_1$ and $R_2$ may be hydrogen.

15. The composition of claim 1 wherein the amine of (C-2) is a polyamine.

16. The composition of claim 1 wherein the amine of (C-2) is an alkylene polyamine.

17. The composition of claim 1 wherein the amine of (C-2) is a hydroxyalkyl-substituted alkylene polyamine.

18. The composition of claim 1 wherein the boron compound is boric acid.

19. The composition of claim 1 wherein the weight ratio of (B-1):(C) is from about 0.1:1 to about 10:1.

20. The composition of claim 1 wherein the weight ratio of (B-1):(C) is from about 0.5:1 to about 5:1.

21. The composition of claim 1 wherein the amount of (C-1) and (C-2) present is an amount to provide from about 0.1 atomic proportion of boron for each mole of said acylated nitrogen intermediate to about 10 atomic proportions of boron for each atomic proportion of nitrogen of said acylated nitrogen intermediate.

22. The composition of claim 1 wherein the soluble nitrogen- and boron-containing composition (C) is prepared by reacting (C-1) with (C-2) at an elevated temperature up to, but not including the decomposition temperature of any reactants or the product of the reaction.

23. A lubricating or functional fluid composition having improved high temperature stability comprising (A) a major amount of an oil of lubricating viscosity, and a minor amount of (B-1) at least one soluble salt of a tertiary aliphatic primary amine containing from about 4 to about 30 carbon atoms with a substituted phosphoric acid composition characterized by the formula

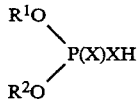

(I)

wherein $R^1$ and $R^2$ are aliphatic hydrocarbyl groups and together contain from about 4 to about 60 carbon atoms, and both X groups are either O or S, and (C) at least one soluble nitrogen- and boron-containing compound prepared by the reaction of (C-1) at least one boron compound selected from the class consisting of boron trioxide, boron halides, boron acids, boron anhydrides, boron amides and esters of boron acids with (C-2) at least one soluble acylated nitrogen intermediate prepared by the reaction of an aliphatic olefin polymer-substituted succinic acid-producing compound having an average of at least about 50 aliphatic carbon atoms in the polymer substituent with at least about one-half equivalent, for each equivalent of acid-producing compound, of an alkylene amine, a hydroxyalkyl-substituted alkylene amine, or a mixture thereof, wherein the relative amounts of (B-1):(C) range from about 0.1:1 to about 10:1 by weight.

24. The composition of claim 23 wherein the phosphoric acid composition of (B-1) comprises a mixture of substituted phosphoric acids characterized by the formula

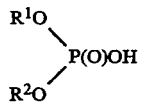

(III)

wherein $R^1$ is hydrogen or a hydrocarbon group and $R^2$ is a hydrocarbon group, the total number of carbon atoms in $R^1$ and $R^2$ is a hydrocarbon group, the total number of carbon atoms in $R^1$ and $R^2$ being from about 4 to about 60.

25. The composition of claim 24 wherein the phosphoric acid composition III comprises a mixture of mono- and di-hydrocarbyl-substituted phosphoric acids.

26. The composition of claim 23 also containing (B-2) at least one di-hydrocarbyl-substituted phosphite characterized by the formula $$(RO)_2P(O)H \quad \text{(II)}$$

wherein each R is a hydrocarbyl group which may be the same or different.

27. The composition of claim 23 wherein the polymer substituent of the succinic acid-producing compound is derived from a polybutene having an Mn value within the range of from about 700 to about 10,000.

28. The composition of claim 23 wherein the amine of (C-2) is a polyalkylene polyamine.

29. The composition of claim 23 wherein the boron compound is boric acid.

30. The lubricant of claim 19 wherein the soluble nitrogen- and boron-containing composition (C) is prepared by reacting (C-1) with (C-2) at an elevated temperature up to, but not including the decomposition temperature of any reactants or the product of the reaction.

31. The composition of claim 23 wherein the weight ratio of (B-1):(C) is from about 0.5:1 to about 5:1.

32. The composition of claim 23 wherein the amount of (C-1) and (C-2) present is an amount sufficient to provide from about 0.1 atomic proportion of boron for each mole of said acylated nitrogen intermediate up to about 10 atomic proportions of boron for each atomic proportion of nitrogen of said acylated nitrogen intermediate.

33. The composition of claim 23 wherein the soluble nitrogen- and boron-containing composition (C) is prepared by reacting (C-1) with (C-2) at a temperature of from about 50° C. to about 250° C.

34. The composition of claim 23 wherein the amine salt (B-1) is derived from a primary amine containing from about 8 to about 14 carbon atoms.

35. The composition of claim 23 containing from about 0.1% to about 5% by weight of (B) and from about 0.1% to about 5% by weight of (C).

36. A composition as defined in claim 1 wherein the composition comprises a grease.

37. A composition as defined in claim 23 wherein the composition comprises a grease.

38. A gear lubricant having improved high temperature stability comprising (A) a major amount of an oil of lubricating viscosity, and a minor amount of (B-1) at least one soluble tertiary aliphatic primary amine salt of a substituted phosphoric acid composition characterized by the formula

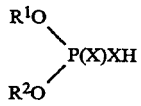

(I)

wherein $R^1$ is hydrogen or an aliphatic hydrocarbyl group, $R^2$ is an aliphatic hydrocarbyl group, and both X groups are either O or S, and (C) at least one soluble nitrogen- and boron-containing compound prepared by the reaction of (C-1) at least one boron compound selected from the class consisting of boron trioxide, boron halides, boron acids, boron anhydrides, boron amides and esters of boron acids with (C-2) at least one soluble acylated nitrogen intermediate prepared by the reaction of a hydrocarbon-substituted succinic acid-producing compound with at least about one-half equivalent, per equivalent of acid producing compound, of an amine containing at least one hydrogen attached to a nitrogen atom, wherein the relative amounts of (B-1):(C) range from about 0.1:1 to about 10:1 by weight.

39. The lubricant of claim 38 wherein the primary amine contains from about 4 to about 30 carbon atoms.

40. The lubricant of claim 38 wherein both X groups are oxygen.

41. The lubricant of claim 38 wherein the hydrocarbyl groups are primary aliphatic groups.

42. The lubricant of claim 38 wherein the phosphoric acid composition of (B-1) comprises a mixture of substituted phosphoric acids prepared by the reaction of at least one hydroxy compound with a phosphorus reactant of the formula $P_2X_5$.

43. The lubricant of claim 38 wherein X is O.

44. The lubricant of claim 38 wherein $R^1$ and $R^2$ contain a total of at least about 4 carbon atoms.

45. The lubricant of claim 38 wherein the total number of carbon atoms in $R^1$ and $R^2$ is from about 4 to about 60.

46. The lubricant of claim 38 also containing at least one (B-2) di-hydrocarbyl-substituted phosphite characterized by the formula $$(RO)_2P(O)H \quad \text{(II)}$$

wherein each R is a hydrocarbyl group which may be the same or different.

47. The lubricant of claim 38 wherein the succinic acid-producing compound of (C-2) contains an average of at least about 50 aliphatic carbon atoms in the substituent.

48. The lubricant of claim 38 wherein the succinic acid-producing compound of (C-2) is selected from the group consisting of succinic acids, anhydrides, esters and halides.

49. The lubricant of claim 38 wherein the hydrocarbon substituent of the succinic acid-producing compound of (C-2) is derived from a polyolefin having an Mn value within the range of from about 700 to about 10,000.

50. The lubricant of claim 49 wherein the polyolefin is a polyisobutene.

51. The lubricant of claim 38 wherein the amine of (C-2) is characterized by the formula $R_1R_2NH$ wherein $R_1$ and $R_2$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups, provided that only one of $R_1$ and $R_2$ may be hydrogen.

52. The lubricant of claim 38 wherein the amine of (C-2) is a polyamine.

53. The lubricant of claim 38 wherein the amine of (C-2) is an alkylene polyamine.

54. The lubricant of claim 38 wherein the amine of (C-2) is a hydroxyalkyl-substituted alkylene polyamine.

55. The lubricant of claim 38 wherein the boron compound is boric acid.

56. The lubricant of claim 38 wherein the weight ratio of (B-1): (C) is from about 0.5:1 to about 5:1.

57. The lubricant of claim 38 wherein the amount of (C-1) and (C-2) present is an amount to provide from about 0.1 atomic proportion of boron for each mole of said acylated nitrogen intermediate to about 10 atomic proportions of boron for each atomic proportion of nitrogen of said acylated nitrogen intermediate.

* * * * *